US012781763B1

(12) United States Patent
Georgakis et al.

(10) Patent No.: US 12,781,763 B1
(45) Date of Patent: Nov. 3, 2026

(54) ASYMMETRIC DIFFUSER FOR TURBINE

(71) Applicant: Transportation IP Holdings, LLC, Norwalk, CT (US)

(72) Inventors: Christos Georgakis, Lincoln (GB); Matthew Elijah Moore, Lincoln (GB); Paul Eifion Roach, Lincoln (GB)

(73) Assignee: Transportation IP Holdings, LLC, Norwalk, CT (US)

( * ) Notice: Subject to any disclaimer, the term of this patent is extended or adjusted under 35 U.S.C. 154(b) by 60 days.

(21) Appl. No.: 19/268,817

(22) Filed: Jul. 14, 2025

(30) Foreign Application Priority Data

Jun. 12, 2025 (GR) ..... 20250100437

(51) Int. Cl.
*F04D 29/44* (2006.01)
*F04D 17/10* (2006.01)
*F04D 29/28* (2006.01)

(52) U.S. Cl.
CPC ..... *F04D 29/441* (2013.01); *F04D 17/10* (2013.01); *F04D 29/284* (2013.01)

(58) Field of Classification Search
CPC ..... F01D 9/026; F01D 9/045; F01D 9/048; F04D 29/441; F04D 29/444; F02B 37/00; F02B 37/24; F02B 39/00; F02B 37/18
See application file for complete search history.

(56) References Cited

U.S. PATENT DOCUMENTS 2,840,342 A * 6/1958 Silvern ..... F01D 25/30 60/697
7,937,942 B2 * 5/2011 Gobert ..... F02D 41/40 415/206
2009/0246010 A1 * 10/2009 Roach ..... F01D 25/30 415/207
2010/0178164 A1 * 7/2010 Loringer ..... F02C 6/12 415/207
2012/0294711 A1 * 11/2012 Grigoriev ..... F04D 29/444 415/204
2017/0108003 A1 * 4/2017 Rusch ..... F04D 29/666

FOREIGN PATENT DOCUMENTS

WO WO-2013/150263 A1 * 10/2013

* cited by examiner

*Primary Examiner* — Courtney D Heinle
(74) *Attorney, Agent, or Firm* — K&L Gates LLP

(57) ABSTRACT

A turbine may include a shaft defining an axis, a turbine blisc, bladed disc or disc rotatable about the axis and supporting a plurality of blades, and a casement positioned around the plurality of blades, where the casement forms a flow path to an outlet. The turbine may include a diffuser protruding into the flow path, where the diffuser is axially asymmetric about the axis. The diffuser can define an ovoidal plate positioned in the flow path. An extended portion of the ovoidal plate can extend through a radial portion of the casement into an elongated portion toward the casement exit.

17 Claims, 13 Drawing Sheets

ASYMMETRIC DIFFUSER FOR TURBINE

CROSS-REFERENCE TO RELATED APPLICATION

This application claims priority to and the benefit of Greece application No. 20250100437, filed Jun. 12, 2025, entitled ASYMMETRIC DIFFUSER FOR TURBINE, the contents of which is hereby incorporated herein.

BACKGROUND

Technical Field

This disclosure relates to turbochargers and turbines thereof.

Discussion Of Art

Vehicles may include an internal combustion engine to combust mixtures of fuel and air. In some examples, power output by the engine may be augmented by compressing intake air prior to combustion at the engine, thereby increasing air charge, e.g., a density of oxygen molecules, and allowing a corresponding amount of injected fuel to be increased. Compression of intake air may be achieved by implementing a turbocharger in the vehicle, with a compressor of the turbocharger coupled to an air intake system of the engine and a turbine of the turbocharger coupled to an exhaust system of the engine. The turbine and compressor are connected by a shaft and rotation of the turbine, as driven by exhaust gas flow, drives rotation of the compressor. It may be desirable to have a turbine that differs from those that are currently available.

BRIEF DESCRIPTION

One general aspect includes a turbine. The turbine may include a shaft defining an axis, a turbine blisc, bladed disc, or disc rotatable about the axis and supporting a plurality of blades, and a casement positioned around the plurality of blades, where the casement forms a flow path to an outlet. The turbine may include a diffuser protruding into the flow path, where the diffuser is axially asymmetric about the axis.

Implementations may include one or more of the following features. The diffuser may include a rim protruding radially into the flow path. A first portion of the rim may define a first radial length, a second portion of the rim may define a second radial length, and the first radial length may be different than the second radial length. The flow path may include a toroidal path around the axis fluidically coupled to an elongated path extending radially away from the axis to the outlet. The second radial length may be greater than the first radial length, where the first radial length extends into the toroidal path and the second radial length extends into the elongated path. The first portion of the rim may define a circular perimeter. The second portion of the rim may define an elliptical perimeter. The second portion of the rim may define a rectangular perimeter. The rectangular perimeter may include rounded corners. The second portion of the rim may define partially a rectangular perimeter and partially an elliptical perimeter. The first portion of the rim may be half of the rim. The turbine may include a fin protruding into the elongated path to the diffuser. The fin may protrude parallel to the axis between the diffuser and an inside wall of the casement. The fin may be oriented perpendicular to the diffuser.

Implementations may further include a rim that forms a continuous loop protruding into the flow path. An opening may be defined through the casement, where the opening is dimensioned and structured to receive the shaft, and where the continuous loop extends around the opening. The diffuser and the casement may form a unitary component.

Implementations may further include a diffuser defining an ovoidal plate protruding into the flow path, the diffuser and the casement forming a unitary component, and/or the shroud insert comprising the diffuser.

One general aspect includes a device. The device may include a casement structured to direct a fluid along a toroidal flow path and an elongated flow path to an outlet. The device may also include a diffuser including a rim protruding radially outward, where a first portion of the rim extends into the toroidal flow path and defines a first radial length, where a second portion of the rim extends into the elongated flow path and defines a second radial length, and where the first radial length is less than the second radial length.

Another general aspect includes a turbocharger. The turbocharger may include a rotor rotatable about an axis, a casement forming a flow path to an outlet, and a diffuser protruding into the flow path, where the diffuser is axially asymmetric about the axis.

BRIEF DESCRIPTION OF THE DRAWINGS

The subject matter described herein may be understood from reading the following description of non-limiting embodiments, with reference to the attached drawings, wherein.

DETAILED DESCRIPTION

This disclosure relates to turbochargers and turbine components thereof. Some components of a turbine may be axially asymmetric about a central axis of rotation of a turbine shaft. For example, the turbine components may include an axially asymmetric diffuser protruding into the fluid flow path through the turbine. Such an arrangement may be desirable in the improvement of engine performance and turbine stage efficiency. For example, during a flow expansion process within a turbine, the fluid moving away from the turbine blades may still carry an amount of recoverable kinetic energy. Efficient recovery of the kinetic energy may improve turbine efficiency and engine performance. However, the turbine may be subjected to geometric constraints based on the position of the turbine relative to other components of the turbocharger, and/or the engine. For example, increasing the axial length of a turbine can be difficult or precluded in certain instances based on maintaining the turbine interfaces with adjacent components, the requirement to fit the turbine within the existing design envelope, and a desired compliance with externally imposed packaging restraints.

An axially asymmetric diffuser may be incorporated into a turbine to increase the turbine stage efficiency through the casement toward the outlet. The diffuser may extend into the fluid flow path to efficiently recover kinetic energy flowing away from the blades towards the outlet of the casement. For example, the casement may form a fluid flow path that includes a toroidal path and an elongated path between the toroidal path and the outlet. The diffuser may extend radially into the toroidal path and asymmetrically along the elongated path toward the outlet.

As an example, a turbine may include a rotor having a shaft defining an axis of rotation and a turbine blisc rotatable about the axis of rotation, where the turbine blisc includes a plurality of blades. The turbine blisc may include both the rotor disc and blades as a single part, for example. In other instances, blades may be individually removable from the rotor as in a bladed disc configuration, for example. The turbine may also include a casement positioned around the plurality of blades and forming a fluid flow path to an outlet of the casement. The turbine may further include a diffuser protruding into the fluid flow path, wherein the diffuser is asymmetric about the axis. The perimeter of the diffuser may be axially asymmetric. In such instances, the turbine may be more efficient in recovering kinetic energy from fluid flowing through the turbine within the geometric and/or volumetric constraints imposed on the turbine and the casement thereof.

Figure 1:
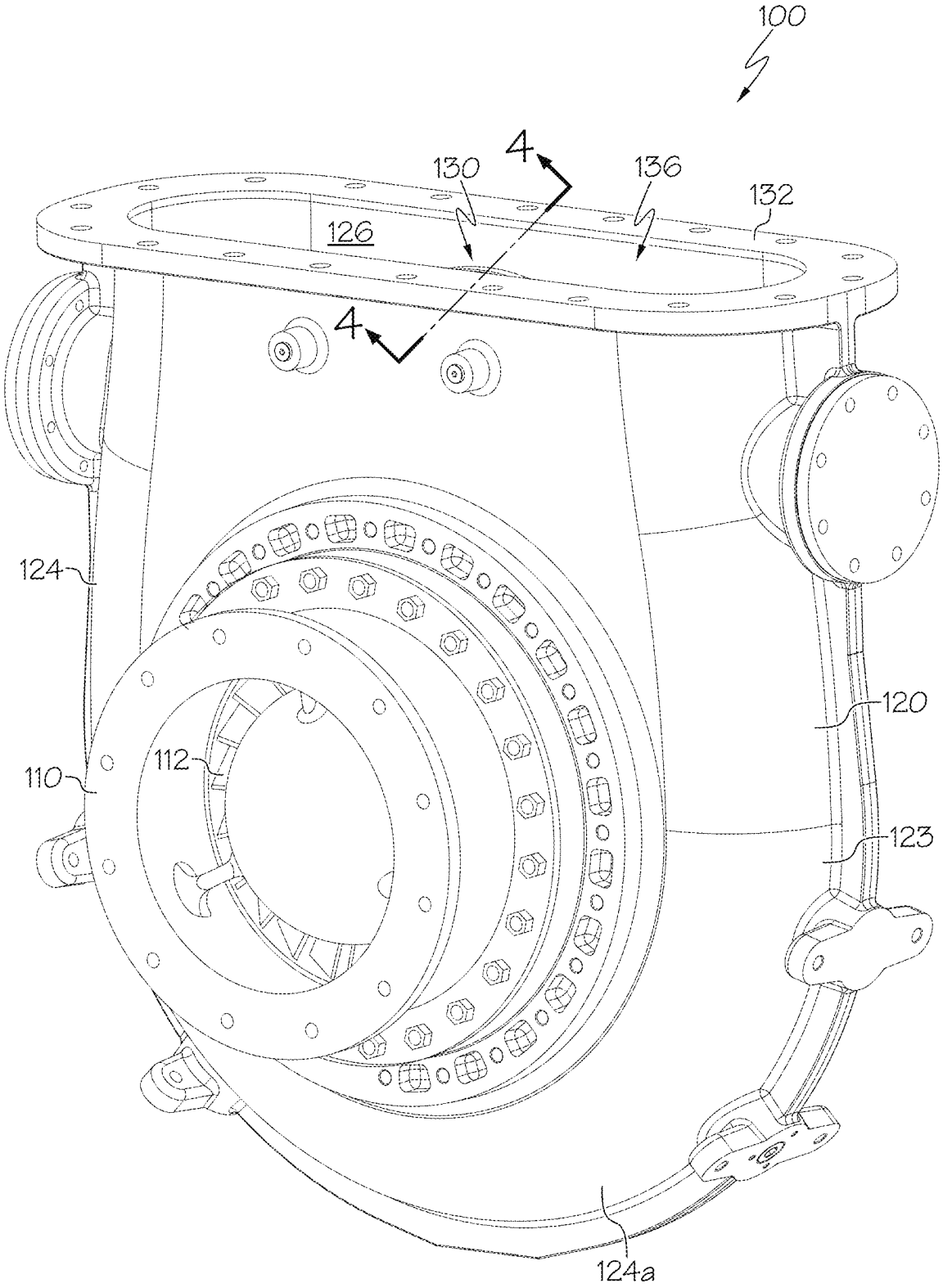
FIG. 1 is a perspective view of a turbine, according to various aspects.
Figure 2:
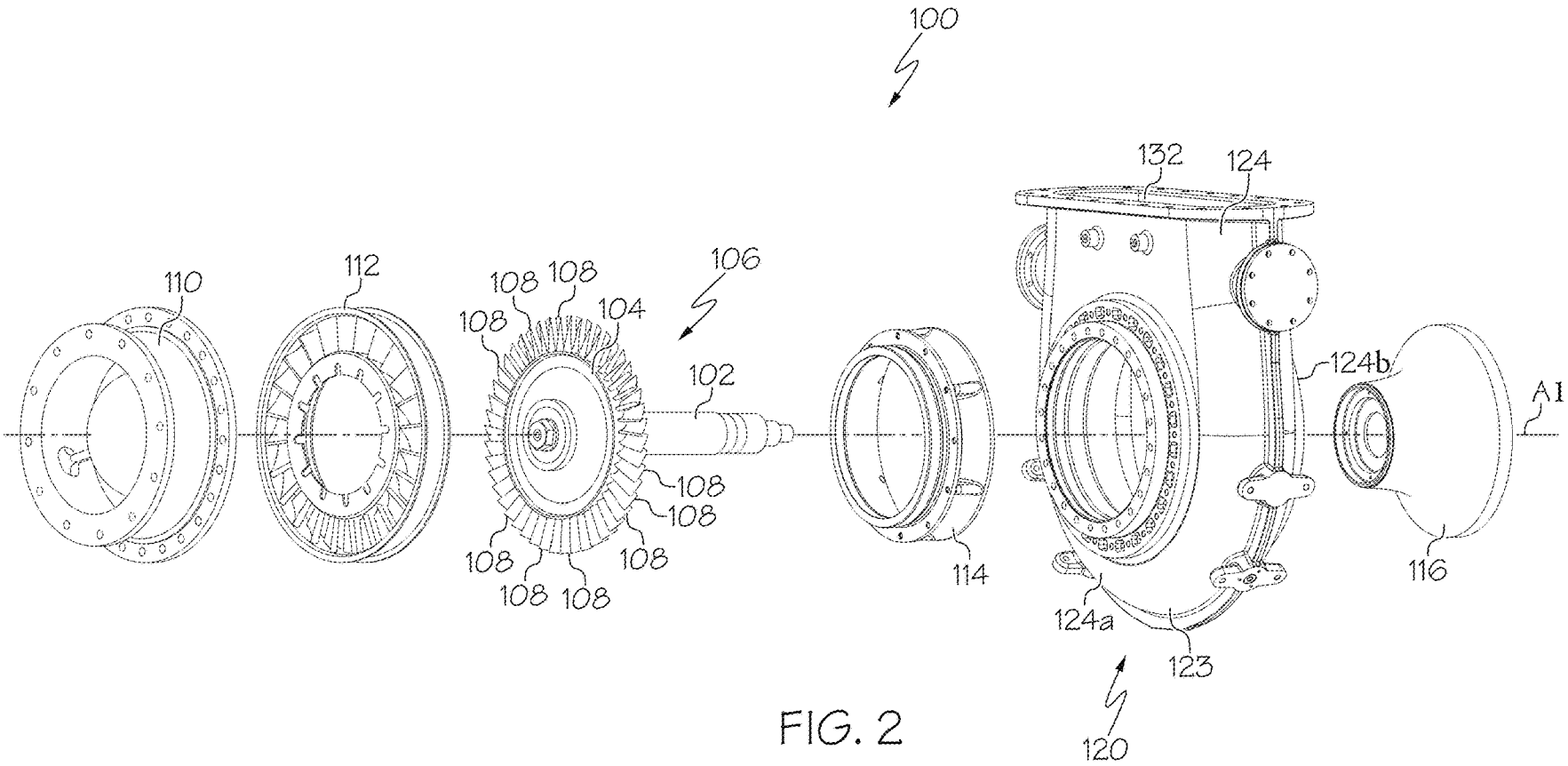
FIG. 2 is an exploded view of the turbine of FIG. 1, according to various aspects.

Referring to FIGS. 1 and 2, a turbine 100 including a casement 120 is shown. The turbine and its components may be incorporated into a turbocharger or other machines, for example. The casement houses a rotational component of the turbine. For example, the rotor 106 extends through the casement. The rotor includes a rotatable shaft 102 extending along an axis A1 and a turbine blisc, or disc, 104 that is rotatable about the rotational axis A1. The turbine blisc supports an array of blades 108 extending radially outward from the turbine blisc center and the rotational axis A1 therethrough. The blades and the turbine blisc may define a unitary part. In other aspects, the blades may be individually removable from the central disc of the rotor as in a bladed disc configuration. The casement is positioned around the array of blades. Inner surfaces of the casement form or define at least a portion of the fluid flow path for fluid exiting from the blades.

Figure 3:
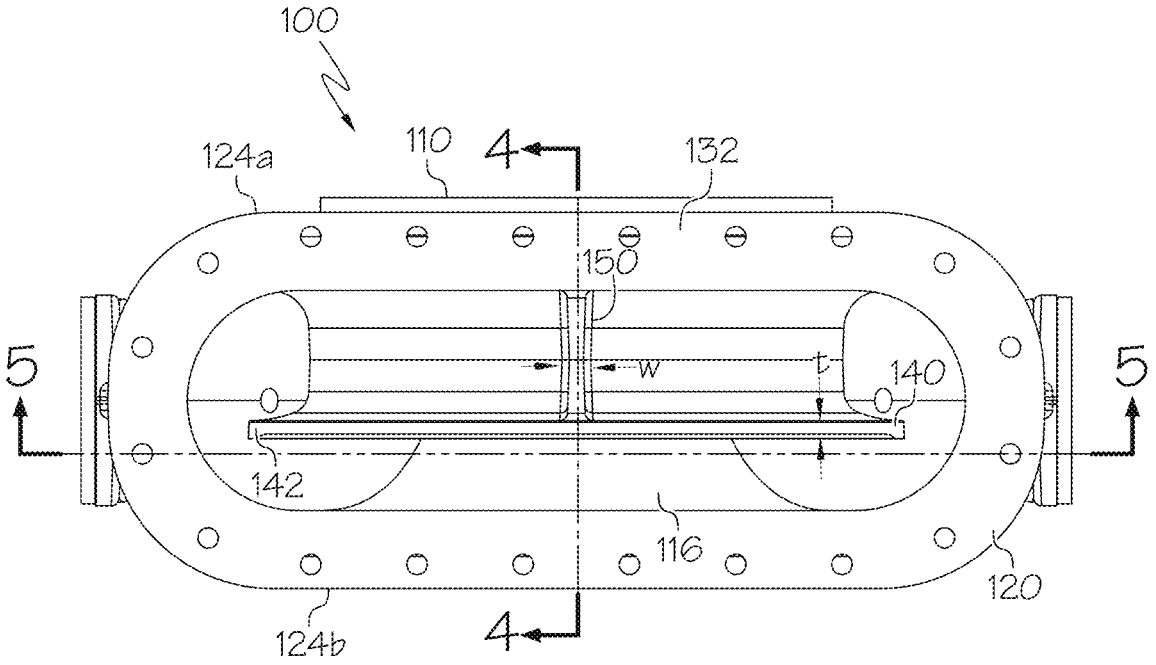
FIG. 3 is a plan view of a shroud body of the turbine of FIG. 1, according to various aspects.
Figure 4:
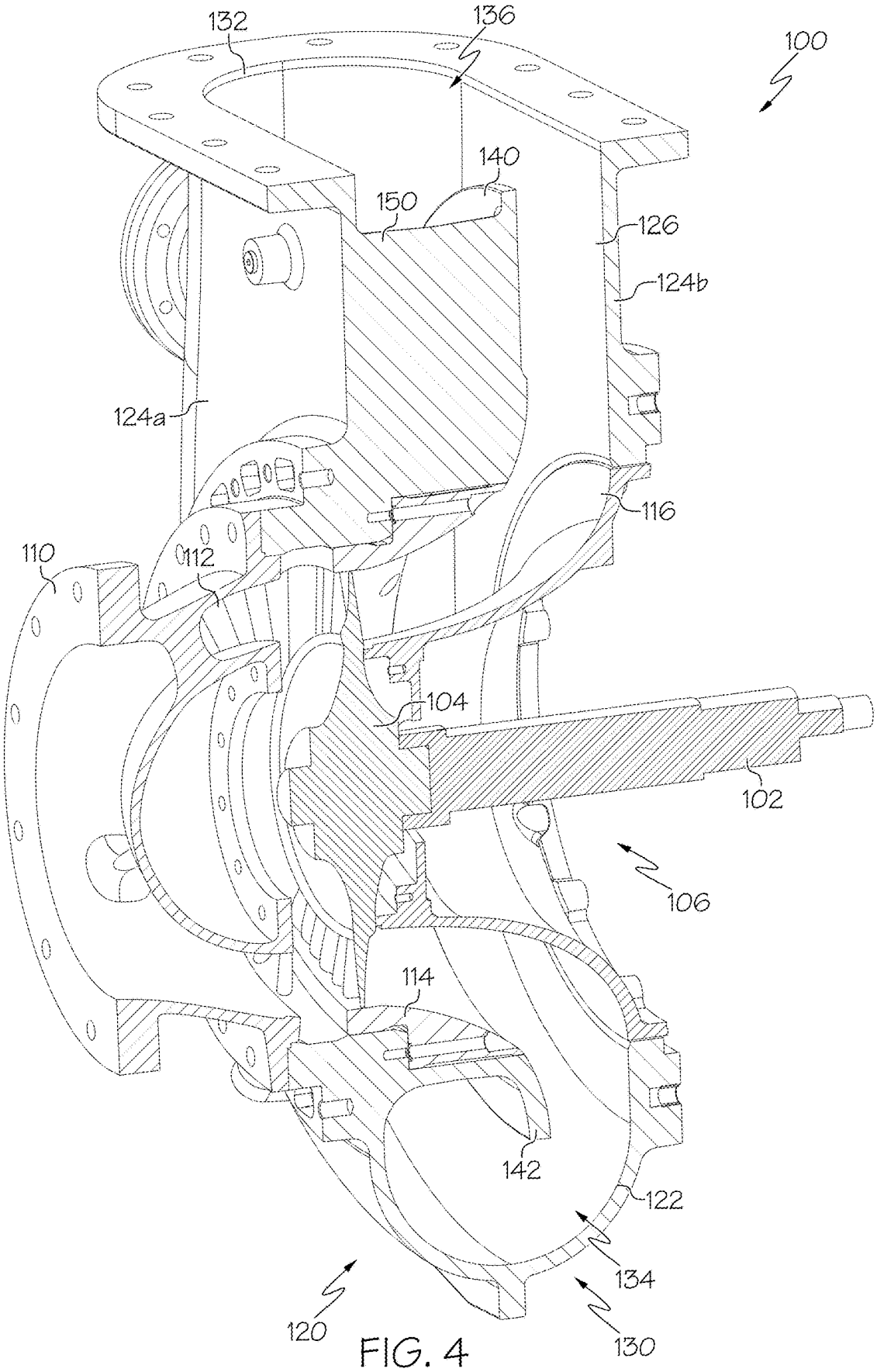
FIG. 4 is a perspective, cross-section view of the turbine of FIG. 1 taken along the plane 4-4 through the turbine of FIG. 1 and the shroud body of FIG. 3, according to various aspects.
Figure 5:
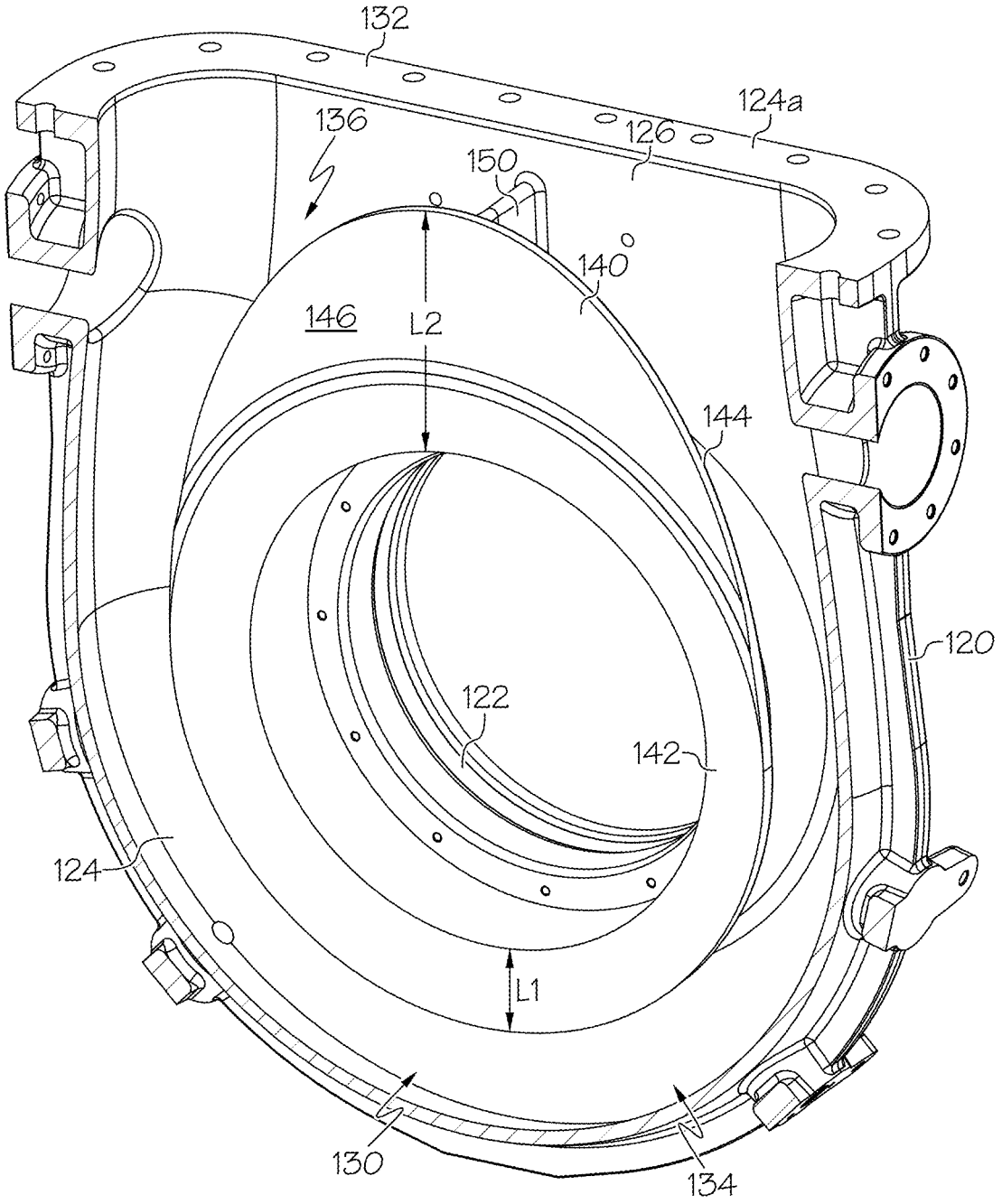
FIG. 5 is a perspective, cross-section view of the shroud body of FIG. 3 taken along the plane 5-5 indicated in FIG. 3, according to various aspects.

Referring primarily to FIGS. 3-5, a diffuser 140 is positioned within the casement. The diffuser protrudes into the fluid flow path and is axially asymmetric about the axis A1. The casement includes a shroud insert 114 and a shroud body 124. The shroud body defines an opening 122 extending from an inlet side 124*a* of the shroud body to an opposite side 124*b* of the shroud body. The opening is dimensioned and structured to receive the rotational shaft of the rotor. The shroud insert is centrally positioned around the rotational axis A1 and is fluidically coupled to the shroud body at the opening. In other instances, the shroud insert and the shroud body can be integrally formed. For example, the shroud insert and the inlet side of the shroud body can define or be a monolithic structure.

The shroud body includes a radial portion 123, which can be shaped like a ring, and an elongated passage 126 that extends radially away from the radial portion to a terminal end that forms a casement outlet 132. Fluid exiting the array of blades moves through the radial portion and along the elongated portion to exit the casement at the casement outlet.

Referring primarily to FIG. 2, the turbine further includes an inlet casing 110 and a nozzle ring 112, such that a fluid is directed through the inlet casing, across the nozzle ring, toward the array of blades and radially outward from the blades into the fluid flow path defined by the radial portion of the shroud body. The nozzle ring may include a ring of stationary vanes for guiding the flow of fluid toward the rotating blades. The turbine further includes a hub insert 116 to support the rotational load on the rotor and rotational shaft extending through the hub insert, for example.

The casement forms the fluid flow path for fluid exiting the array of blades. The fluid flow path includes a toroidal path 134 that is positioned annularly around the axis. For example, the radial portion of the shroud body may form at least a portion of the toroidal path or an arc length. Fluid exiting the array of blades is expelled into the toroidal path. The fluid flow path may include a portion that is an elongated path 136 that extends radially away from the axis to the casement outlet. For example, the elongated passage of the shroud body may form at least a portion of the elongated path. Fluid diverted along the toroidal path passes through the elongated path prior to exiting the turbine at the casement outlet.

The diffuser and the casement may form a unitary and/or seamless component. For example, the diffuser may be an integrally formed feature of the casement or a portion thereof. In various aspects, the diffuser and the casement (or portion thereof) may be formed together, such as by casting, additive manufacturing, or molding, for example. In some instances, the diffuser and the casement (or portion thereof)

may be the same material. Suitable materials may include various metals, ceramics, and cermets; and, in some cases, the materials may be organic or partially so.

In various aspects, the shroud insert includes the diffuser. In such instances, the diffuser is an integral part or feature of the shroud insert. In various aspects, incorporating the diffuser into the shroud insert may allow existing turbines and casement therefor to be retrofit with the diffuser by replacing a shroud insert with a shroud insert having an integrated diffuser.

In other instances, the diffuser may be attached or secured to the casement during a secondary step. In such instances, the diffuser may be comprised of the same material as the casement or a different material.

The diffuser includes a rim 142 that protrudes radially into the flow path. The rim may form a continuous loop protruding into the flow path. The rim is asymmetric relative to the rotational axis A1.

For example, the rim may define a variable length around the perimeter thereof. Referring primarily to FIG. 5, a first portion of the rim may define a first radial length L1 and a second, or extended, portion of the rim may define a second, or extended, radial length L2 that is different than the first radial length L1. The radial length of the rim may gradually change or transition between the first radial length L1 and the extended radial length L2.

The extended portion of the rim may be the portion of the rim that extends along the elongated passage and/or into the elongated path. For example, the extended portion of the rim may be aligned with the elongated passage such that the extended portion extends through the shroud body and into the elongated passage of the casement. The first, or non-extended, portion of the rim may be the portion that is not aligned with the elongated passage or the elongated fluid path. The first portion of the rim may be the portion that extends into the toroidal path and/or within the shroud body. The first radial length L1 may be confined by the inner radius of the shroud body. For example, the shroud body may define an inner radial length for the toroidal flow path and the second radial length L2 of the rim may be greater than the inner radial length.

In various instances, the rim may include a perimeter 144. A portion of the perimeter may define a circular perimeter. For example, the first portion of the rim may have a circular perimeter. A portion of the rim may further define an elliptical perimeter. For example, the extended portion of the rim may have an elliptical perimeter. The rim may smoothly transition from the circular perimeter to the elliptical perimeter to form an egg-shaped or ovoidal perimeter. For example, the rim of the diffuser may define an ovoidal plate 146 protruding into the flow path. The opening through the casement extends through the ovoidal plate.

The first portion of the rim may form half of the rim and the second, or extended, portion of the rim may form another half of the rim. In other instances, the first portion or the second portion may define less than or more than half the rim. In certain instances, the rim may define additional portions having different maximum radial lengths than the first portion or the elongated portion.

Alternative diffusers are contemplated. For example, FIGS. 12-15 depict a second diffuser 440, a third diffuser 540, a fourth diffuser 640, and a fifth diffuser 740, respectively. Each diffuser is axially asymmetric about the rotational axis A1. Moreover, each diffuser includes a non-extended portion 442, 542, 642, 742 and an extended portion 444, 544, 644, 744. The radial length L1 of each non-extended portion is less than the radial length L2 of the corresponding extended portion. For example, the non-extended portions define a circular perimeter. The extended portion of the second diffuser (FIG. 12) is elliptical, the extended portion of the third diffuser (FIG. 13) is rectangular, the extended portion of the fourth diffuser (FIG. 14) is rectangular with rounded corners, and the extended portion of the fifth diffuser (FIG. 15) is partially rectangular and partially elliptical.

Referring primarily to FIGS. 3-5, the turbine may include a fin 150. The fin may support the diffuser. The fin may protrude into the elongated path. More specifically, the fin may extend from the outlet side of the casement to the diffuser. The fin may extend toward the diffuser in the direction of the rotational axis A1. For example, the fin may protrude into the elongated path in a direction parallel to the rotational axis A1. The fin may be oriented perpendicular to the diffuser. For example, the fin may join and support the diffuser along a connection that forms a right angle between the fin and the diffuser.

The fin and the diffuser may form a unitary component. For example, the fin and the diffuser may be an integrally formed feature of the casement. In various aspects, the rim, the fin, and the casement may be formed together, such as by casting or molding, for example. In such instances, the rim, fin, and the casement may be comprised of the same material.

In other instances, the fin may be attached or secured between the casement and the diffuser during a secondary step. In such instances, the diffuser may be comprised of the same material as the casement and/or the diffuser, or a different material than the casement and/or the diffuser.

The fin may be the same thickness as the diffuser. For example, referring primarily to FIG. 3, the width w of the fin can be the same as the thickness t of the diffuser 140. In other instances, the fin can be narrower than the diffuser or narrower than a portion of the diffuser. In still other instances, the fin can be wider than the diffuser or wider than a portion of the diffuser.

Although the foregoing axially asymmetric diffuser is described with respect to a turbocharger, alternative turbine, compressor, and pump applications are contemplated. For example, an axially asymmetric diffuser may be utilized in a device having a casement structured to direct a fluid along a toroidal flow path and an elongated flow path toward an outlet where an elongated portion of the diffuser extends through the toroidal flow path into the elongated flow path toward the outlet.

Figure 6:
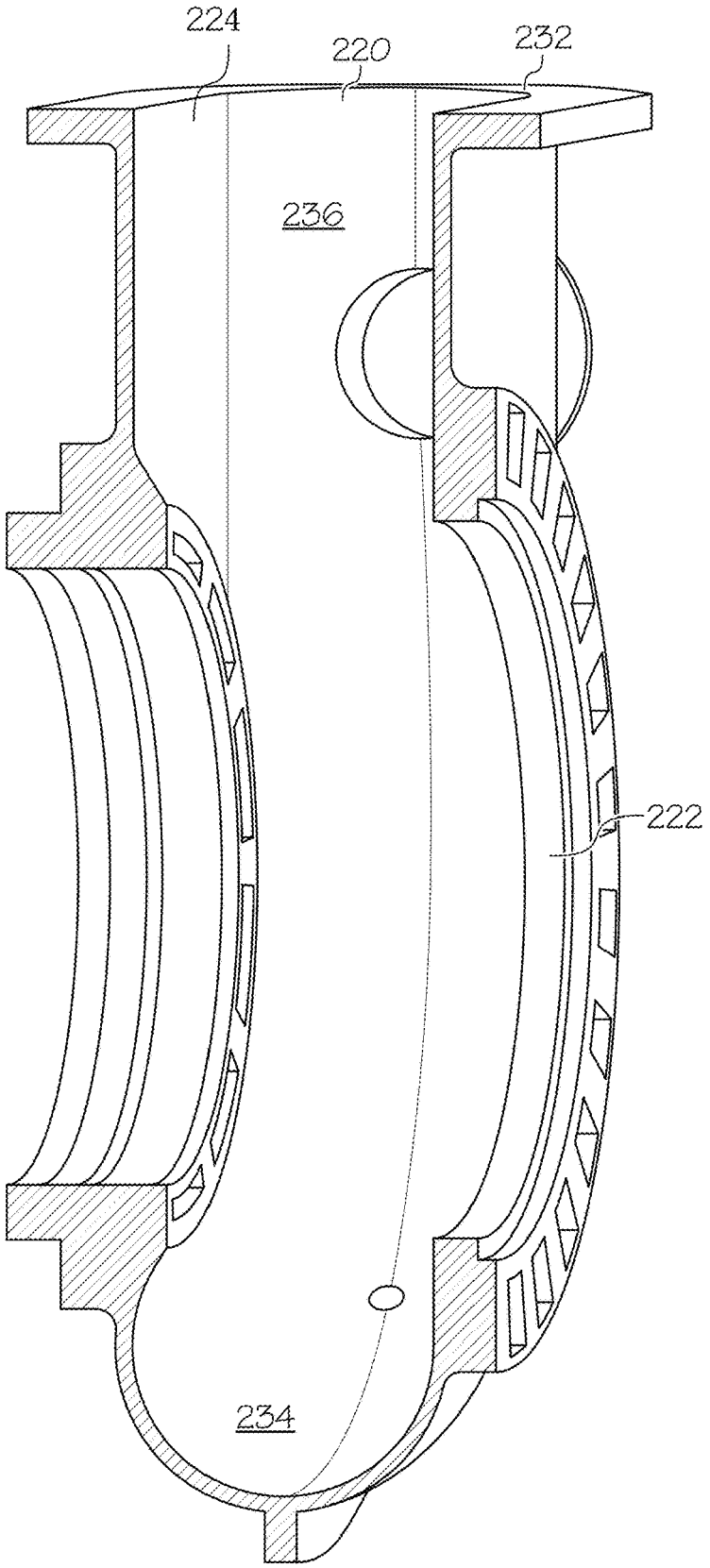
FIG. 6 is a perspective, cross-section view of a second shroud body for a turbine taken along a first plane, according to various aspects.
Figure 7:
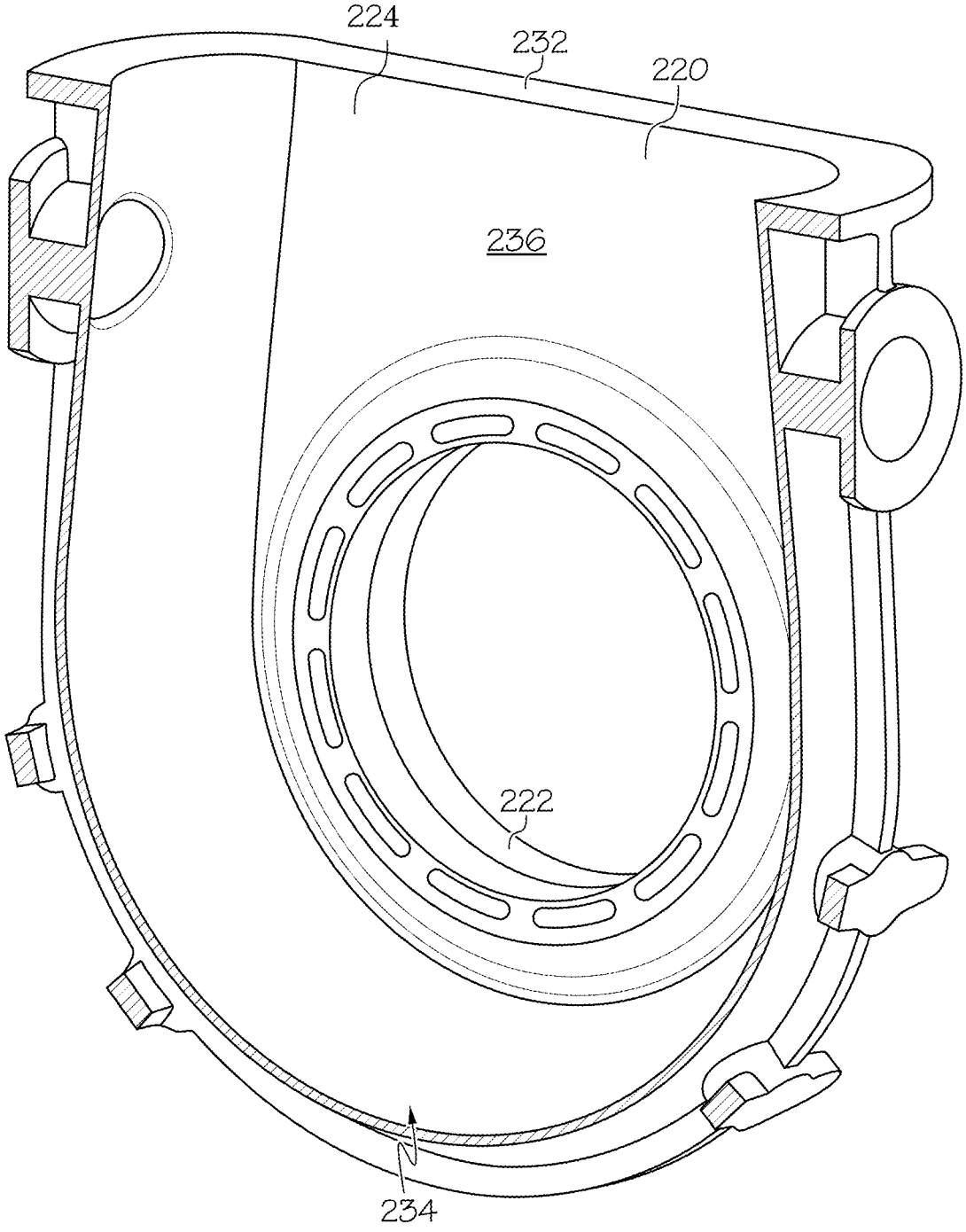
FIG. 7 is a perspective, cross-section view of the second shroud body of FIG. 6 taken along a second plane orthogonal to the first plane, according to various aspects.
Figure 7A:
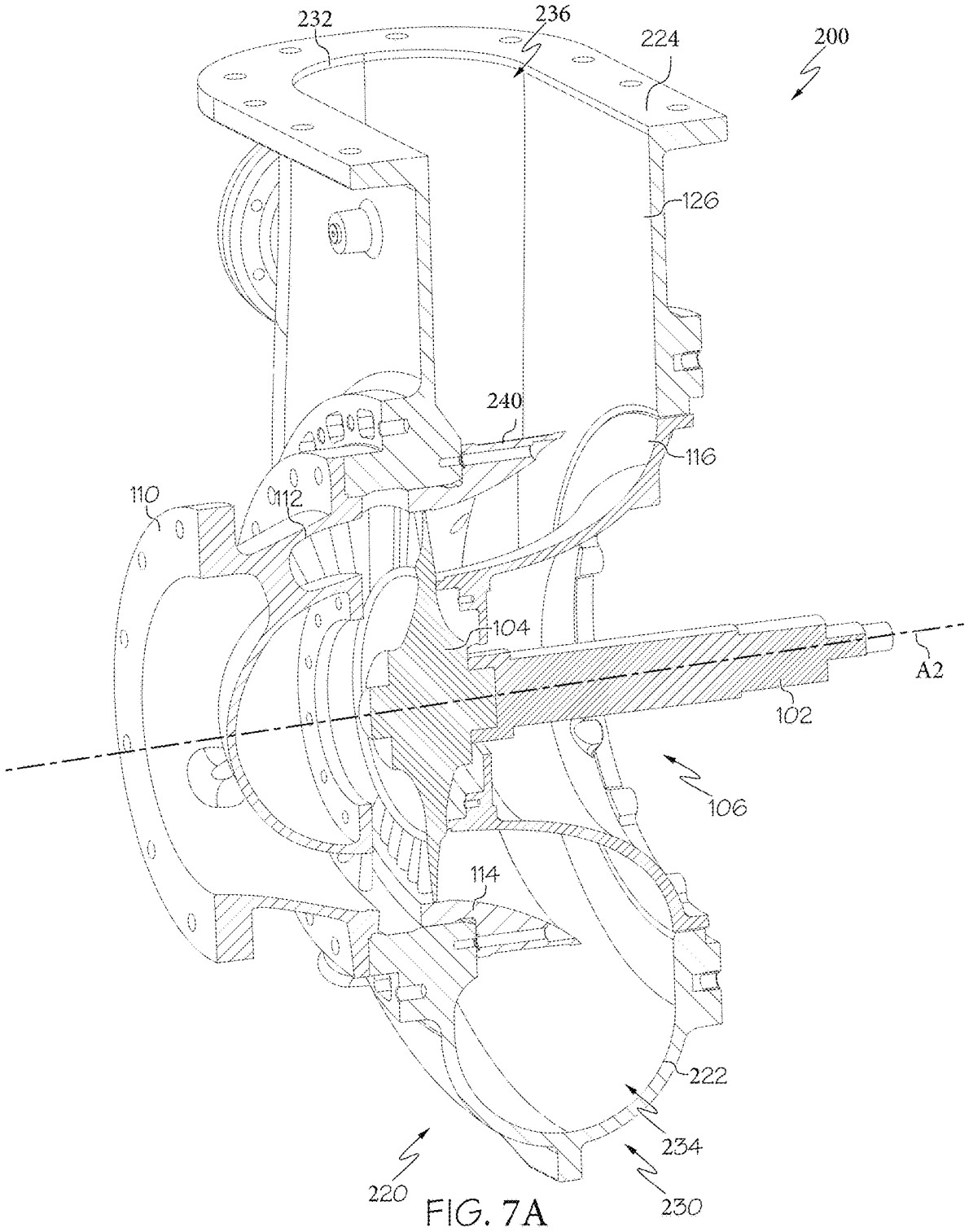
FIG. 7A is a perspective, cross-section view of a turbine including the second shroud body of FIG. 6 taken along a third plane, where the turbine includes an axially symmetric diffuser formed between a shroud insert and a hub insert thereof, according to various aspects.
Figure 8:
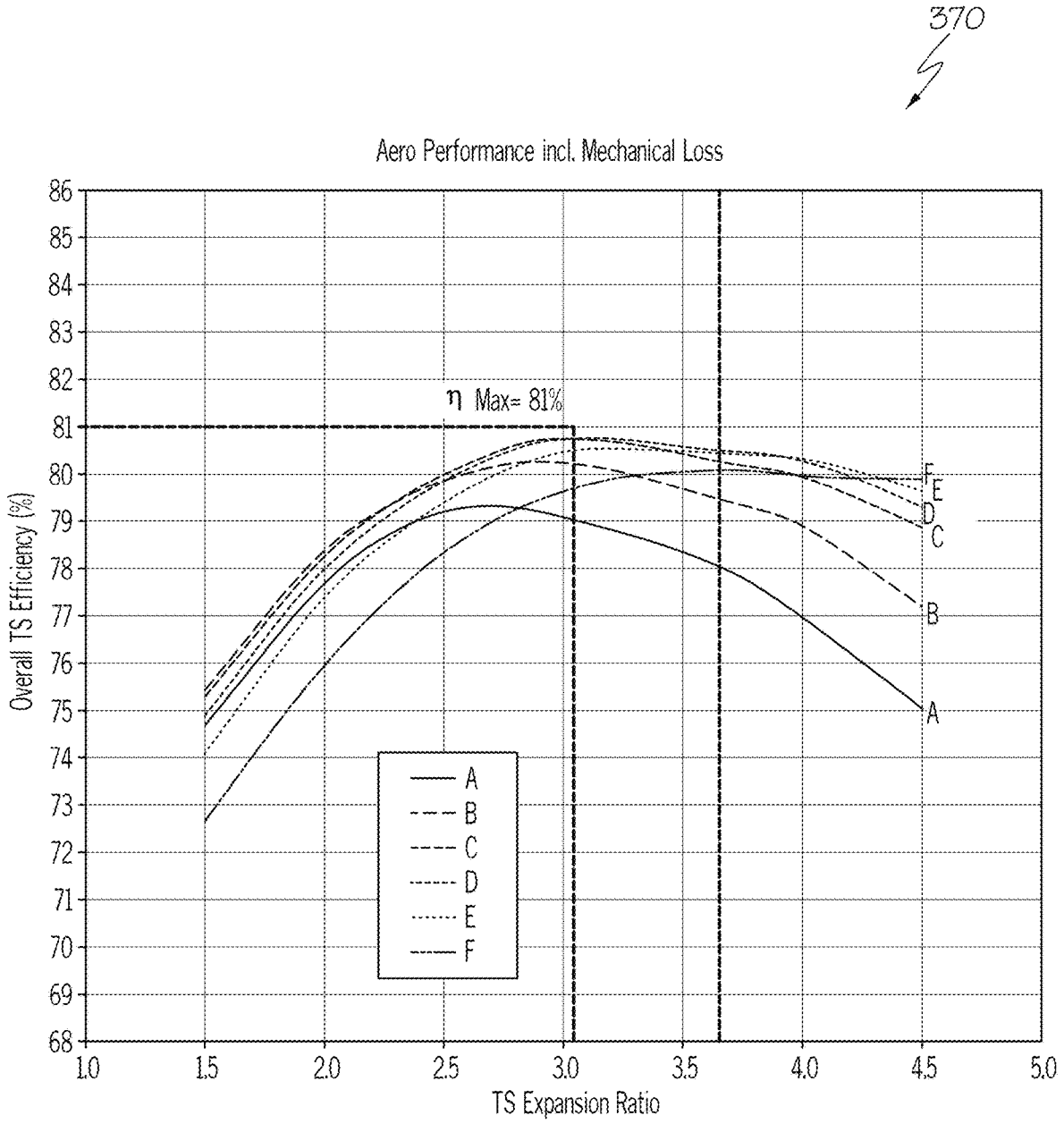
FIG. 8 is a graphical representation of exemplary performance metrics for a first group of turbines with an axially symmetric diffuser, according to various aspects.
Figure 9:
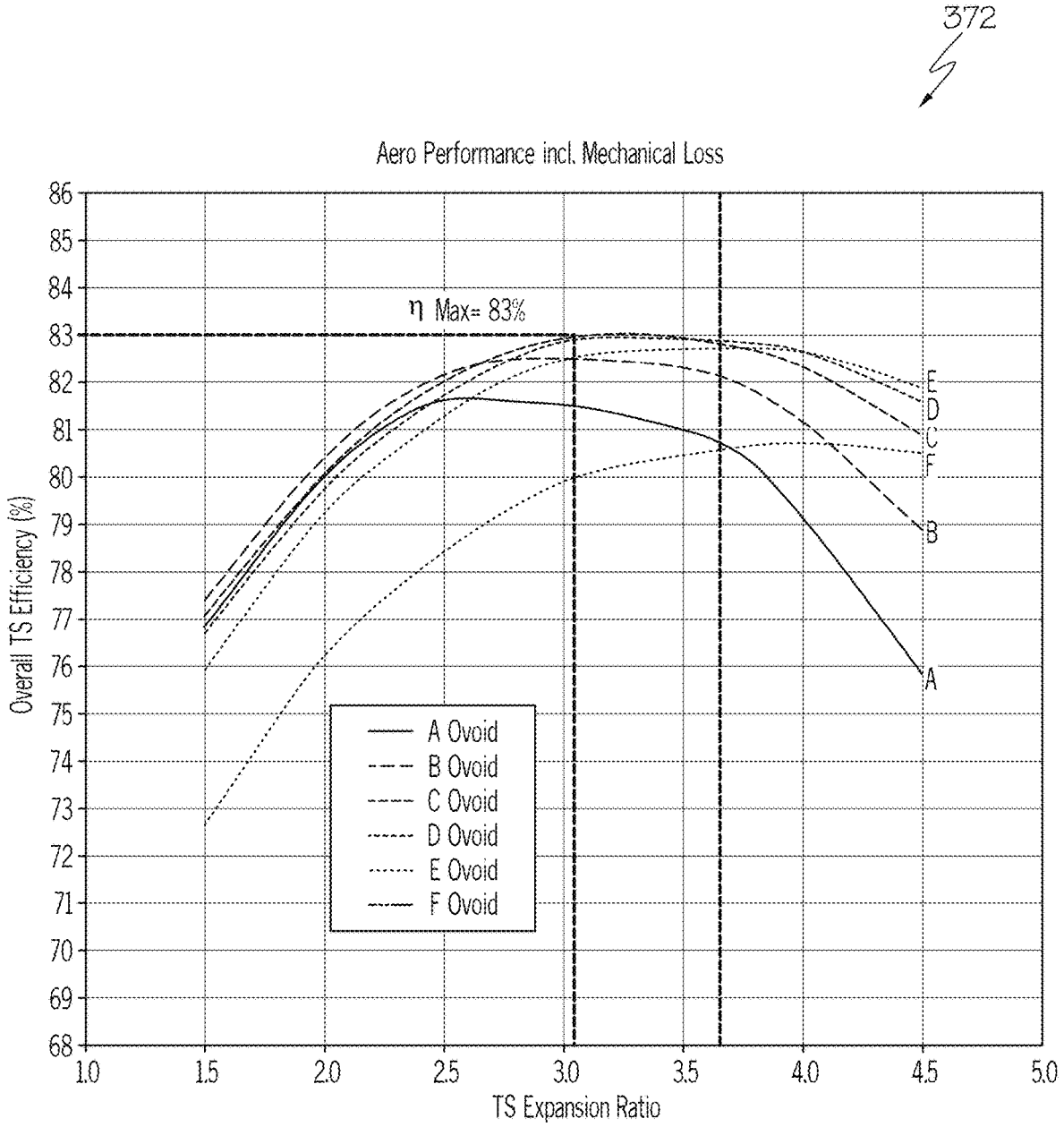
FIG. 9 is a graphical representation of exemplary performance metrics for a second group of turbines with an axially asymmetric diffuser, according to various aspects.
Figure 10:
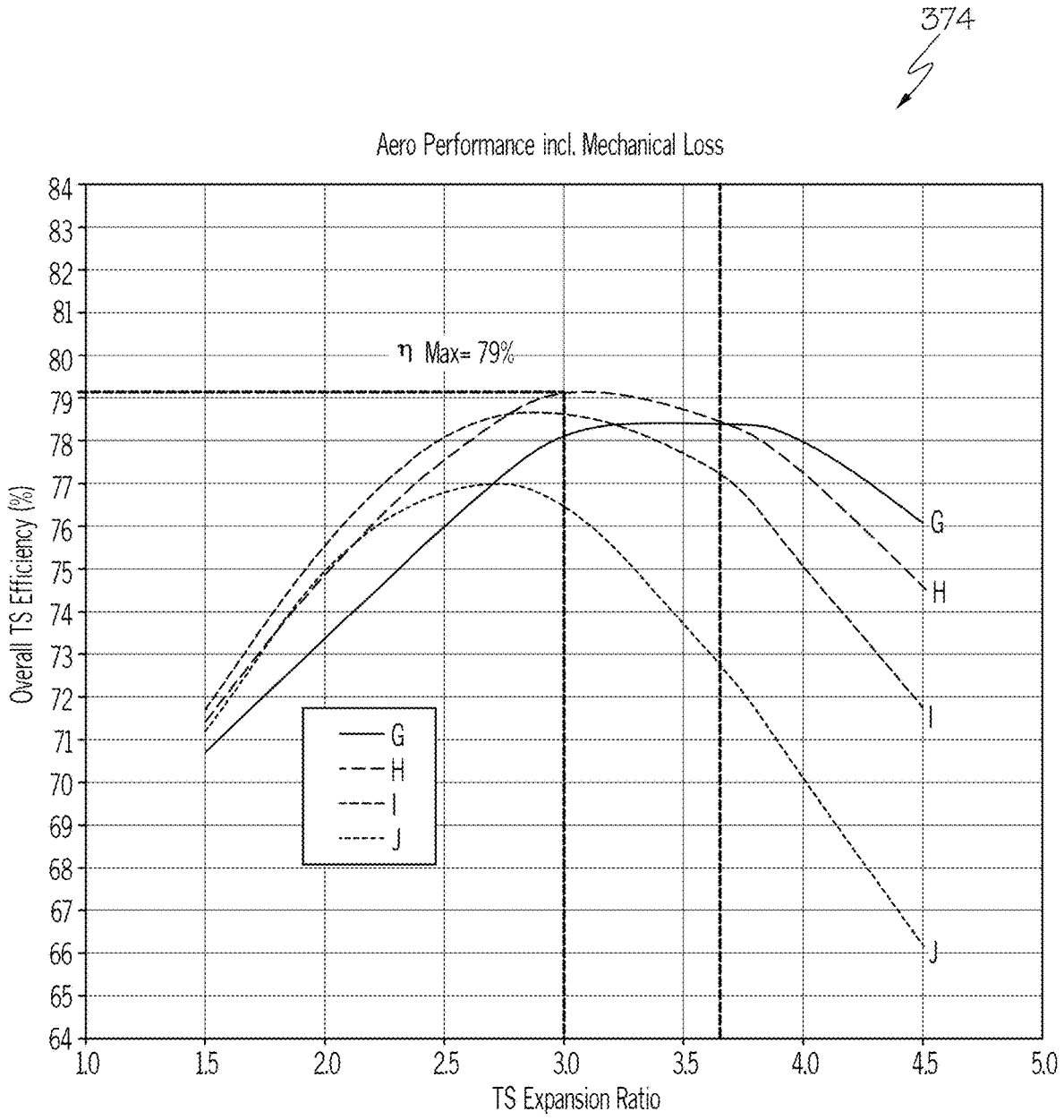
FIG. 10 is a graphical representation of exemplary performance metrics for a third group of turbines with an axially symmetric diffuser, according to various aspects.
Figure 11:
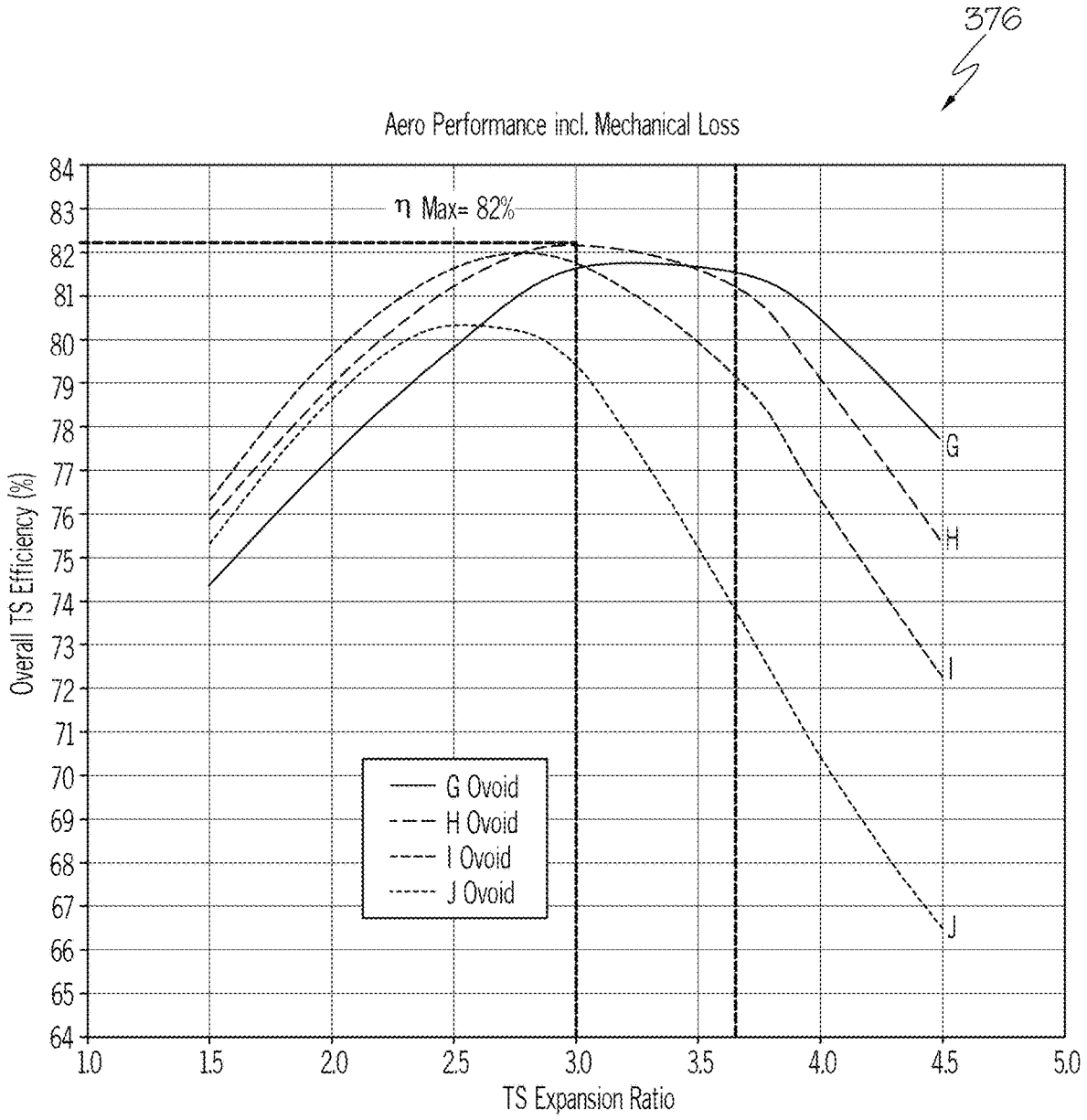
FIG. 11 is a graphical representation of exemplary performance metrics for a fourth group of turbines with an axially asymmetric diffuser, according to various aspects.
Figure 12:
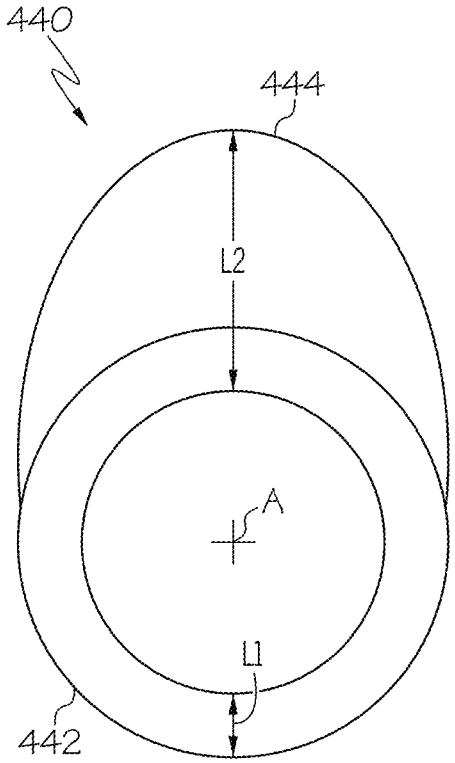
FIG. 12 is an elevation view of an ovoid diffuser, according to various aspects.
Figure 13:
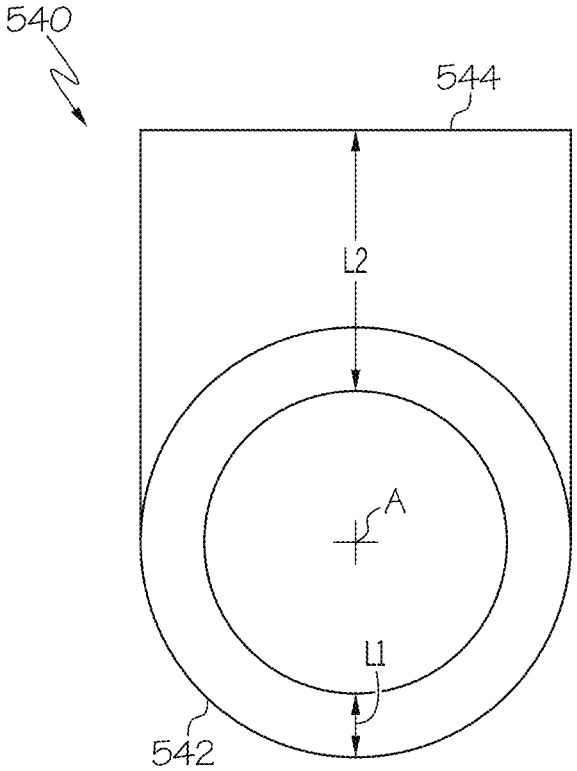
FIG. 13 is an elevation view of an asymmetric diffuser with a circular perimeter portion and a rectangular perimeter portion, according to various aspects.
Figure 14:
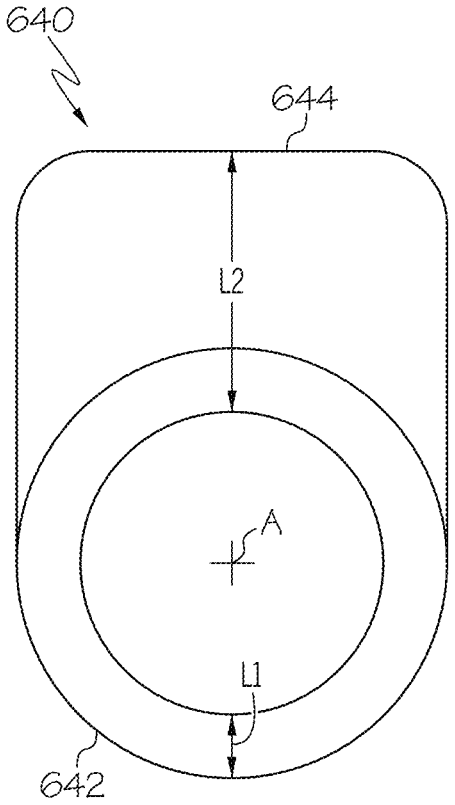
FIG. 14 is an elevation view of an asymmetric diffuser with a circular perimeter portion and a rectangular perimeter portion having rounded corners, according to various aspects.
Figure 15:
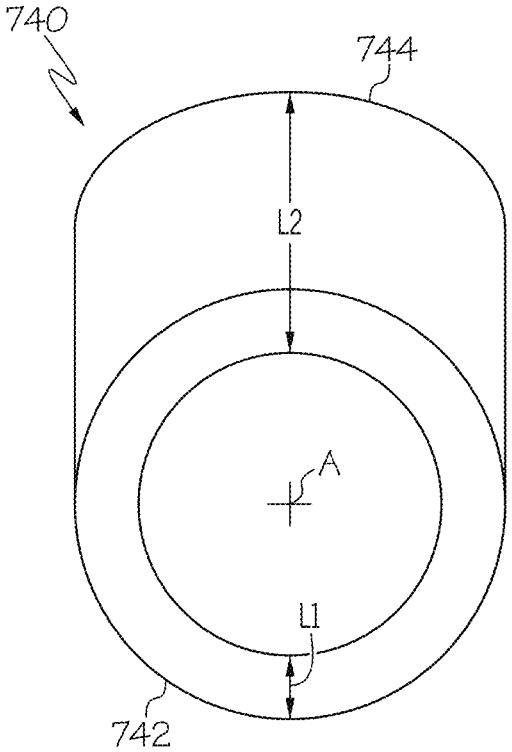
FIG. 15 is an elevation view of an asymmetric diffuser with a circular perimeter portion, a rectangular perimeter portion, and an elliptical perimeter portion, according to various aspects.

Referring primarily to FIGS. 6 and 7A, a second shroud body 224 is shown. The second shroud body does not include an axially asymmetric diffuser. The second shroud body can be assembled with the shroud insert to form a second casement 220. Moreover, the second shroud body 224 can be used with the inlet casing, the nozzle ring, the rotor, and the hub insert to form a second turbine 200 depicted in FIG. 7A. An opening 222 is defined in the second shroud body; the opening is axially symmetric with respect to the rotational axis A2 of the rotor extending therethrough. The inlet side of the second shroud body is shown in FIG. 6. A fluid flowing into the second shroud body via the opening exits the turbine blades in a toroidal path 234 and moves around the toroidal path to an elongated path 236 to flow out a casement exit 232 of the second shroud body. The second turbine further includes an axially symmetric diffuser 240, which is axially symmetric with respect to a rotational axis A2 of the rotor. The axially symmetric diffuser is formed between the shroud insert and the hub insert. This axially symmetric diffuser is relatively small in length and radial extension; the axially symmetric diffuser does not penetrate through an elongated path 236 of the second turbine toward the casement exit thereof.

Turbines with an axially asymmetric diffuser may have efficiency gains of more than 2% relative to their symmetric siblings. In some instances, the efficiency gains can be less than 2%. Even small efficiency gains (e.g. less than 1% or 0.5%) can amount to a meaningful and significant improvement for a turbine. Tradeoffs in volumetric constraints and geometric constraints can, in some instances, allow for equivalent performance but in a smaller footprint.

Comparing the performance of turbines with and without an asymmetric diffuser, one would expect to obtain performance metrics similar to those depicted in FIGS. 8-11. A first graph 370 (FIG. 8) depicts performance curves for a first group of turbines that are with a symmetric diffuser (e.g. the diffuser 240 in FIG. 7A). A second graph 372 (FIG. 9) depicts performance curves for a second group of turbines with an axially asymmetric diffuser in the form of an ovoid diffuser (e.g. the diffuser 140 FIGS. 3-5). Comparing the first and second graphs, the efficiency increases from 81% to 83% in favor of the turbine with the axially asymmetric diffuser, corresponding to an increase of 2%.

Similarly, a third graph 374 (FIG. 10) depicts performance curves for a third group of turbines with a symmetric diffuser (e.g. the diffuser 240 in FIG. 7A). A fourth graph 376 (FIG. 11) depicts performance curves for a fourth group of turbines with an axially asymmetric diffuser in the form of an ovoid diffuser (e.g. the diffuser 140 in FIGS. 3-5). Comparing the third and fourth graphs, the efficiency increases from 79% to 82% in favor of the turbine with the axially asymmetric diffuser, corresponding to an increase of 3%.

One or more components may be described as "configured to," "configurable to," "operable/operative to," "adapted/adaptable to," or similar terms. Unless explicitly stated, these terms encompass components in both active and inactive states. Unless stated otherwise, terms like "including" or "having" should be interpreted as open-ended (i.e., "including but not limited to"). Numeric claim recitations generally mean "at least" the stated number, and disjunctive terms like "A or B" should be interpreted to include either or both unless explicitly specified. Operations in any claim may generally be performed in any order unless explicitly stated. The recitation "at least one of A, B, and C" should be interpreted as any combination of A, B, and C, such A alone, B alone, C alone, A and B together, A and C together, B and C together, and/or A, B, and C together. The recitation "at least one of A, B, or C" should be interpreted to include A alone, B alone, C alone, A and B together, A and C together, B and C together, and/or A, B, and C together.

This written description may disclose several embodiments of the subject matter, including the best mode, and may enable one of ordinary skill in the relevant art to practice the embodiments of subject matter, including making and using any devices or systems and performing any incorporated methods. The patentable scope of the subject matter is defined by the claims, and may include other embodiments that may occur to one of ordinary skill in the art. Such other embodiments may be intended to be within the scope of the claims if they may have structural elements that may not differ from the literal language of the claims, or if they may include equivalent structural elements with insubstantial differences from the literal languages of the claims.

What is claimed is:

1. A turbine, comprising:

a shaft defining an axis;

a turbine blisc, bladed disc, or disc rotatable about the axis and supporting a plurality of blades;

a casement positioned around the plurality of blades, and a surface of the casement forms at least a portion of a flow path to an outlet; and a diffuser defining an ovoidal plate protruding into the flow path, and the diffuser is axially asymmetric about the axis.

2. The turbine of claim 1, wherein the diffuser comprises a rim protruding radially into the flow path.

3. The turbine of claim 2, wherein a first portion of the rim defines a first radial length, and a second portion of the rim defines a second radial length, and the first radial length is different than the second radial length.

4. The turbine of claim 3, wherein the flow path comprises a toroidal path around the axis fluidically coupled to an elongated path extending radially away from the axis to the outlet.

5. The turbine of claim 4, wherein the second radial length is greater than the first radial length, wherein the first radial length extends into the toroidal path, and wherein the second radial length extends into the elongated path.

6. The turbine of claim 5, wherein the first portion of the rim defines a circular perimeter.

7. The turbine of claim 3, wherein the first portion extends for at least half of the rim.

8. The turbine of claim 2, wherein the rim forms a continuous loop protruding into the flow path.

9. The turbine of claim 8, wherein an opening is defined through the casement, and the opening is dimensioned and structured to receive the shaft, and wherein the continuous loop extends around the opening.

10. The turbine of claim 4, further comprising a fin protruding into the elongated path to the diffuser, wherein the fin protrudes between the diffuser and an inside wall of the casement, and wherein the fin is oriented parallel to the axis defined by the shaft.

11. The turbine of claim 4, further comprising a fin protruding into the elongated path to the diffuser, wherein the fin is oriented perpendicularly to the diffuser.

12. The turbine of claim 1, wherein the diffuser and the casement are a seamless and unitary component.

13. The turbine of claim 1, further comprising a shroud insert comprising the diffuser.

14. A turbine, comprising:

a shaft defining an axis;

a turbine blisc, bladed disc, or disc rotatable about the axis and supporting a plurality of blades;

a casement positioned around the plurality of blades, a surface of the casement forms at least a portion of a flow path to an outlet, the flow path comprises a toroidal path around the axis fluidically coupled to an elongated path extending radially away from the axis to the outlet; and a diffuser protruding into the flow path, the diffuser being axially asymmetric about the axis, the diffuser comprising a rim protruding radially into the flow path, a first portion of the rim defining a first radial length, a second portion of the rim defining a second radial length that is different than the first radial length, the second radial length being greater than the first radial length, the first radial length extending into the toroidal path, the second radial length extending into the elongated path, the first portion of the rim defining a circular perimeter, and the second portion of the rim defining an elliptical perimeter.

15. A turbine, comprising:

a shaft defining an axis;

a turbine blisc, bladed disc, or disc rotatable about the axis and supporting a plurality of blades;

a casement positioned around the plurality of blades, a surface of the casement forms at least a portion of a flow path to an outlet, the flow path comprises a toroidal path around the axis fluidically coupled to an elongated path extending radially away from the axis to the outlet; and a diffuser protruding into the flow path, the diffuser being axially asymmetric about the axis, the diffuser comprising a rim protruding radially into the flow path, a first portion of the rim defining a first radial length, a second portion of the rim defining a second radial length that is different than the first radial length, the second radial length being greater than the first radial length, the first radial length extending into the toroidal path, the second radial length extending into the elongated path, the first portion of the rim defining a circular perimeter, and wherein the second portion of the rim defining a rectangular perimeter.

16. The turbine of claim 15, wherein the rectangular perimeter comprises rounded corners.

17. The turbine of claim 15, wherein the second portion of the rim further defines partially an elliptical perimeter.

* * * * *